US007867026B1

(12) United States Patent
Serino

(10) Patent No.: US 7,867,026 B1
(45) Date of Patent: Jan. 11, 2011

(54) BOARD MOUNTED ELECTRICAL CONNECTOR HAVING A DUAL CORE CONDUCTOR

(75) Inventor: Peter John Serino, El Cajon, CA (US)

(73) Assignee: Altera Corporation, San Jose, CA (US)

( * ) Notice: Subject to any disclaimer, the term of this patent is extended or adjusted under 35 U.S.C. 154(b) by 0 days.

(21) Appl. No.: 11/692,532

(22) Filed: Mar. 28, 2007

(51) Int. Cl.
*H01R 9/05* (2006.01)

(52) U.S. Cl. ..... 439/581; 439/63

(58) Field of Classification Search ..... 439/638, 439/540.1, 579, 63, 581
See application file for complete search history.

(56) References Cited

U.S. PATENT DOCUMENTS 5,030,122 A * 7/1991 Birch et al. ..... 439/188
6,065,976 A * 5/2000 Wang ..... 439/63
6,079,986 A * 6/2000 Beshears ..... 439/63
6,139,369 A * 10/2000 Arwidi et al. ..... 439/638
6,152,743 A * 11/2000 Fox ..... 439/63
6,997,753 B2 * 2/2006 Broomall et al. ..... 439/638

* cited by examiner

*Primary Examiner*—Renee Luebke
*Assistant Examiner*—Vanessa Girardi
(74) *Attorney, Agent, or Firm*—Martine Penilla & Gencarella, LLP

(57) ABSTRACT

The present invention is directed to an electrical connector having a body, three connector ends and a plurality of electrically conductive elements passing through the body. The electrically conductive elements are spaced-apart from a central axis of one of the connector ends and collinear with one of the two remaining conductor ends. Specifically, the body extends from a first aperture, terminating in two spaced-apart termini, each of which includes an aperture, defining second and third apertures. A first volume extends between the first and second apertures, and a second volume extends between the first and third apertures. A first subset of a plurality of spaced-apart electrically conductive elements extends through the first volume. A second subset of the plurality of spaced-apart electrically conductive elements extends through the second volume.

16 Claims, 4 Drawing Sheets

BOARD MOUNTED ELECTRICAL CONNECTOR HAVING A DUAL CORE CONDUCTOR

BACKGROUND

The present invention relates to electrical connectors and, in particular, to a coaxial connector suitable for high frequency signal propagation.

Electrical connectors are designed to work at various frequencies. A typical design of an electrical connector is for use with coaxial cables, referred to as a coaxial cable connector (CCC). As a result, CCCs typically facilitate electrical connections employing multiple fasteners. For example, one side of a CCC couples to electronic circuitry employing standard wire-solder techniques, with an opposing side having a fastener suitable for coupling to a coaxial cable. As a result, CCCs may include one of a myriad of fastening mechanisms, e.g., threaded, bayonet, braces, push pull and the like.

Given the drive for integration in the modern electronics industry many CCCs consume more area than desired in an overall electronics system. For example, often CCCs are employed with printed circuit board (PCB) technology that facilitates transmission of signals produced by PCB circuitry over coaxial cables. As a result, a substantial portion of PCB area is consumed with CCCs.

A need exists, therefore, to reduce the area required to couple coaxial cables to an electronics system.

SUMMARY

The present invention is directed to an electrical connector having a body, three connector ends and a plurality of electrically conductive elements passing through the body. The electrically conductive elements are spaced-apart from a central axis of one of the connector ends and collinear with one of the two remaining conductor ends. Specifically, the body extends from a first aperture, terminating in two spaced-apart termini, each of which includes an aperture, defining second and third apertures. A first volume extends between the first and second apertures, and a second volume extends between the first and third apertures. A first subset of a plurality of spaced-apart electrically conductive elements extends through the first volume. A second subset of the plurality of spaced-apart electrically conductive elements extends through the second volume. These and other aspects of the invention will become apparent from the following detailed description, taken in conjunction with the accompanying drawings, illustrating by way of example the principles of the invention.

DETAILED DESCRIPTION OF THE INVENTION

Figure 1:
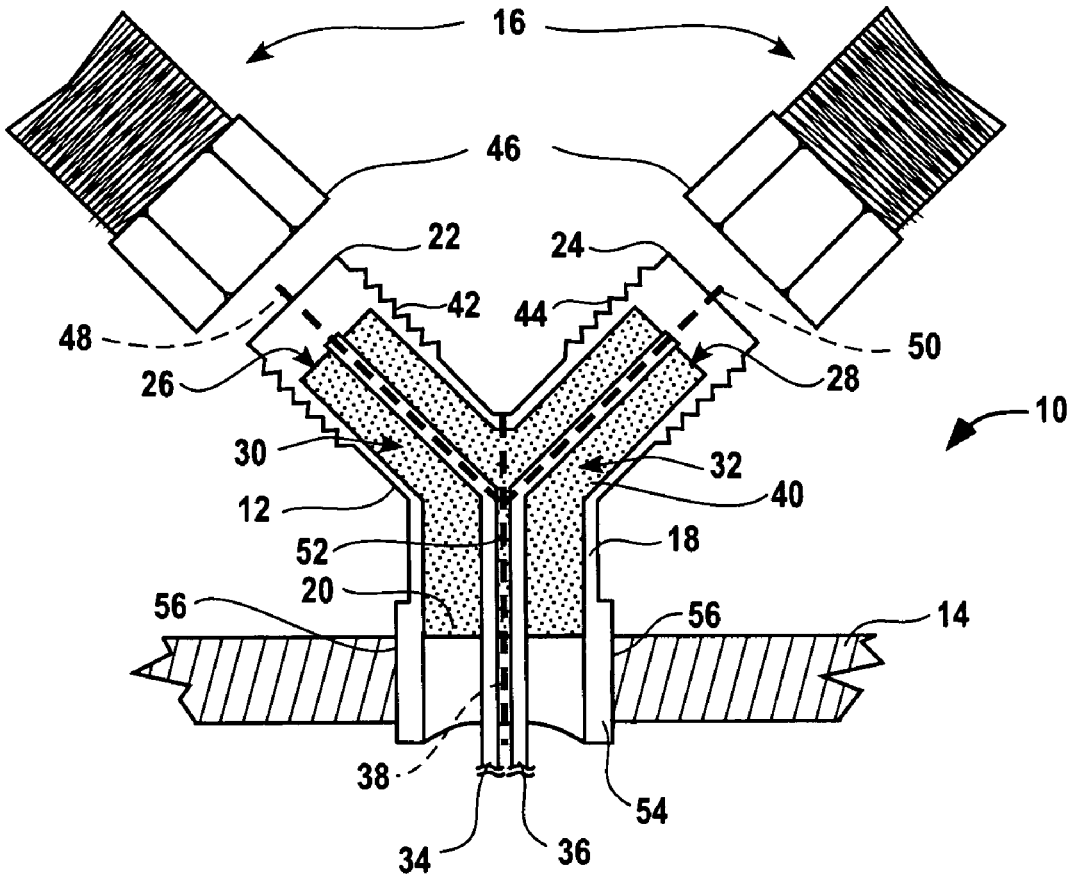
FIG. 1 is a simplified cross-sectional view of an electronics system employing a connector mounted to a printed circuit board in accordance with a first one embodiment of the present invention.

Referring to FIG. 1, an electronics system 10, in accordance with one embodiment of the present invention, employs a connector 12 mounted to a printed circuit board (PCB) 14 and allows coupling to more than one coaxial cable 16 to a common region of PCB 14. To that end, connector 12 includes a body 18 that may be manufactured from any known material suitable for the application, such as aluminum, steel, polymer resin and the like. Body 18 extends from a first aperture 20, terminating in first and second spaced-apart termini 22 and 24. First terminus 22 is spaced-apart from both first aperture 20 and second termini 24. Similarly, second terminus 24 is spaced-apart from first aperture 20. Body 18 defines, proximate to first terminus 22, a second aperture 26. Body 18 defines, proximate to second terminus 24, a third aperture 28. The areas of body 18 that define first aperture 20 are radially symmetrically disposed about a central axis 38, also referred to as an axis of symmetry 38. The areas of body 18 that define second aperture 26 are radially symmetrically disposed about a central axis 48, also referred to as an axis of symmetry 48, and the areas of body 18 that define third aperture 28 are radially symmetrically disposed about a central axis 50, also referred to as an axis of symmetry 50.

The space defined by body 18 between first and second apertures 20 and 26 defines a first volume 30, and the space defined by body 18 between first and third apertures 20 and 28 defines a second volume 32. Extending between first, second and third apertures 20, 26 and 28 are a plurality of electrically conductive elements ECEs 34 and 36. ECEs 34 and 36 may be formed from any suitable conductive material, such as aluminum, copper, gold and the like. As shown, ECE 34 extends through first volume 30 between first aperture 20 and second aperture 26. ECE 36 extends through second volume 32 between first aperture 20 and third aperture 28. Both ECEs 34 and 36 are electrically insulated from an exterior of body 18, as well as each other. Electrical insulation from an exterior of body 18 may be achieved using many techniques, including forming body 18 from an electrically insulative (dielectric) material. An example of this embodiment (not shown) would include having ECE 34 filling first volume 30, excepting a portion thereof lying proximate to central axis 38 in which dielectric material would be disposed to electrically isolate ECE 34 from ECE 36. ECE 36 would fill second volume 32, excepting a portion thereof lying proximate to central axis 38.

In the embodiment shown, connector 12 is configured as a subminiature version A (SMA) connector. As a result, ECEs 34 and 36 extend through a dielectric material 40 that substantially fills first volume 30 and second volume 32, excepting the region thereof occupied by ECEs 34 and 36. Integrally formed in body 18 and extending from first termini 22 toward first aperture 20 are threads 42. Threads 44 are integrally formed in body 18 and extend from second termini 24 toward first aperture 20. The size and spacing between threads 42 and 44 are dimensioned to facilitate coupling to nuts 46 of coaxial cables 16. To facilitate electrical communication between conductive elements (not shown) of coaxial cables 16, an end of ECE 34 is disposed so as to lie on central axis 48. For the same reason, an end of ECE 36 is disposed in aperture 28 so as to lie on central axis 50. By virtue of a portion 52 of dielectric material 40 being positioned so as to keep ends of ECEs 34 and 36 extending from first aperture 20 electrically isolated from one another, ends ECEs 34 and 36 extend through first aperture 20, spaced-apart from central axis 38 thereof.

Figure 2:
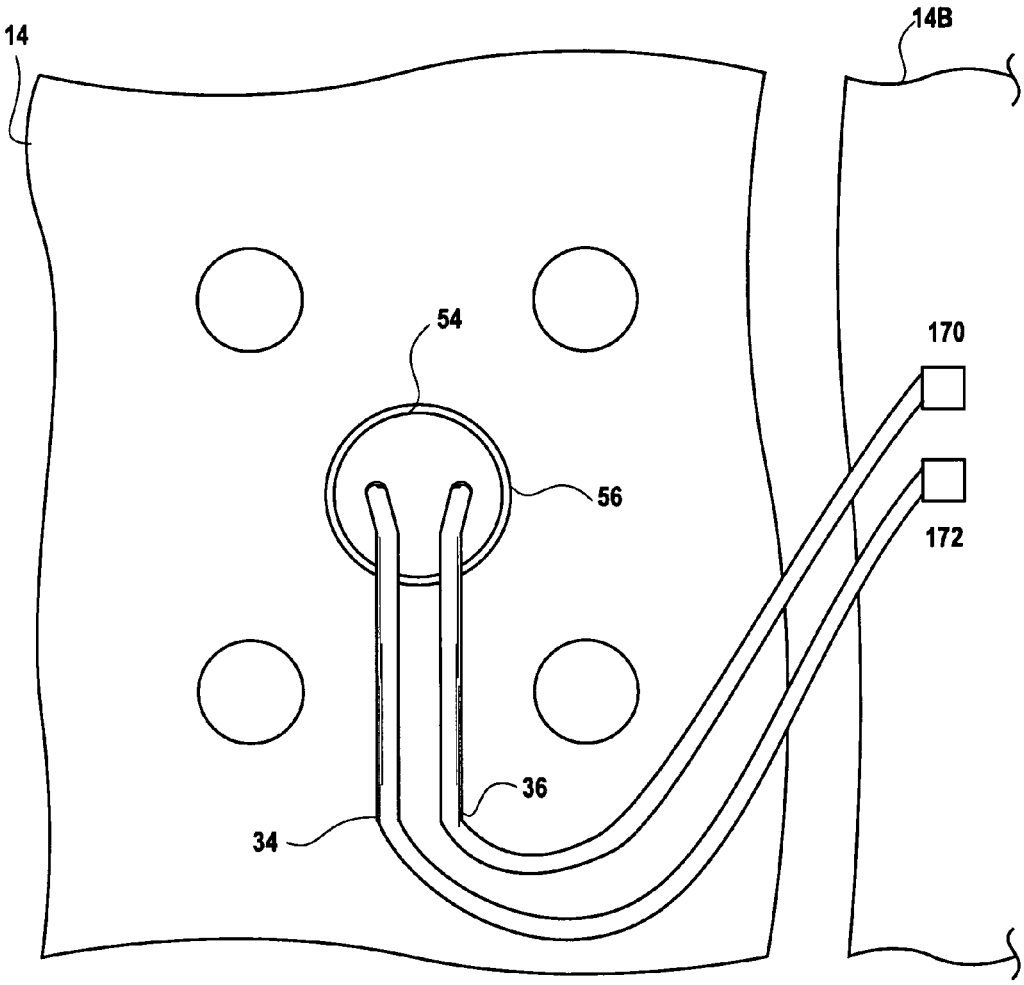
FIG. 2 is a bottom-up view of the system shown in FIG. 1.

Referring to both FIGS. 1 and 2, first aperture 20 is defined by a segment of body 18 that forms a bulwark 54 of the same.

Bulwark 54 is of sufficient structural integrity to support coupling of connector 12 to PCB 14, for example, by fitting the same into a throughway 56 formed in PCB 14. In the present example, bulwark 54 is an integrally formed portion of body 18 having a greater thickness than the remaining portions of body 18.

Figure 3:
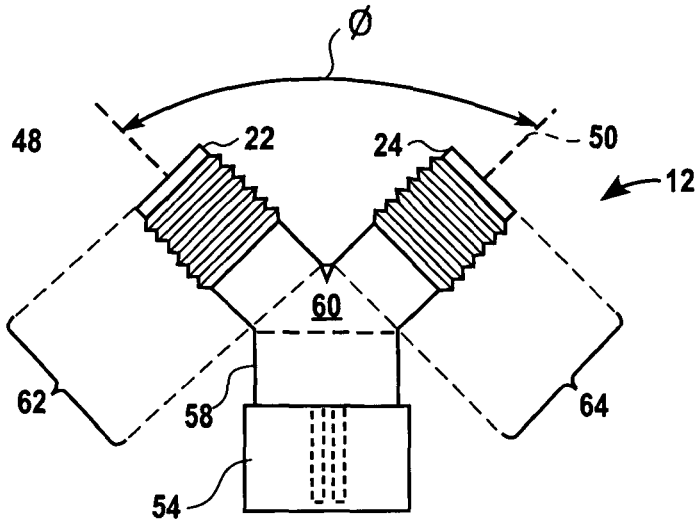
FIG. 3 is side view of the connector shown in FIG. 1.

Referring to both FIGS. 1 and 3, a first portion 58 of body 18 extends from bulwark 54 and terminates in a region defining a junction 60. A second portion 62 of body 18 extends from junction 60, away from both bulwark 54, and terminates in first termini 22. A third portion 64 of body 18 extends away from bulwark 54 and second portion 62 terminating in termini 24 such that axes of symmetry 48 and 50 form a right angle $\phi$ therebetween. As a result connector 12 is said to have a "Y" configuration. In the "Y" configuration a segment of electrical conductive element 34 extending through second portion 62 lies on central axis 48, forming a right angle with respect to a segment of electrically conductive element 36 extending through third portion 64 and an oblique angle with respect to the segment of electrically conductive element 34 extending through first portion 58. Similarly a segment of electrical conductive element 34 extending through second portion 62 lies on central axis 48, forming a right angle with respect to a segment of electrically conductive element 36 extending through third portion 64 and an oblique angle with respect to the segment of electrically conductive element 34 extending through first portion 58.

Figure 4:
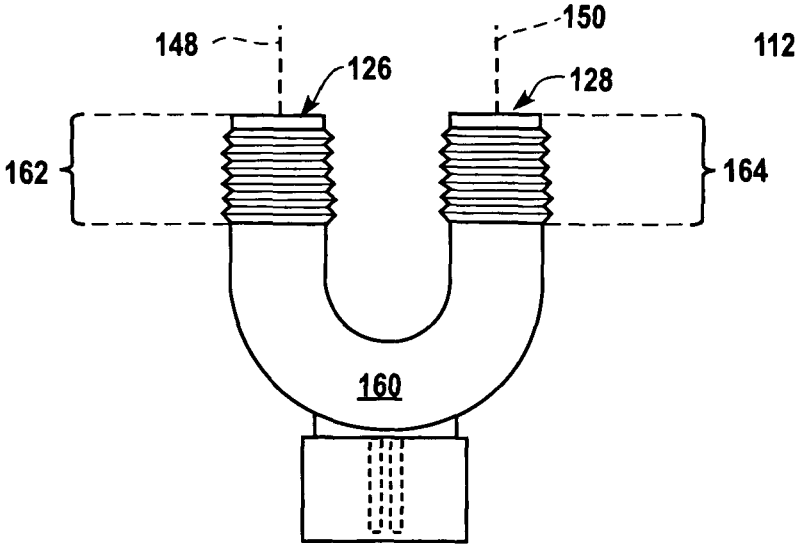
FIG. 4 is a side view of the connector shown in FIG. 1 in accordance with a first alternate embodiment of the present invention.

In another embodiment connector 112 is formed as substantially described above with respect to FIGS. 1 and 3; however, second and third portions 162 and 164, shown in FIG. 4, extend from junction 160 so that axis of symmetry 148 of aperture 126 extends parallel to axis of symmetry 150 of aperture 128. As a result, connector is said to have a "U" configuration. In both the "U" configuration and the "Y" configuration, shown in FIG. 1, the ends of electrically conductive elements 34 and 36 project away from first aperture 20 and extend beyond bulwark 54 so as to have a length to pass completely through PCB 14. This facilitates coupling the same to a conductive pad (not shown) of an adjacent PCB 14B or bond pads 170 and 172, shown in FIG. 2, either of which may be disposed on a side of PCB 14B opposite to the side upon which bulwark 54 is attached. Typically electrically conductive elements are attached using standard solder techniques.

Figure 5:
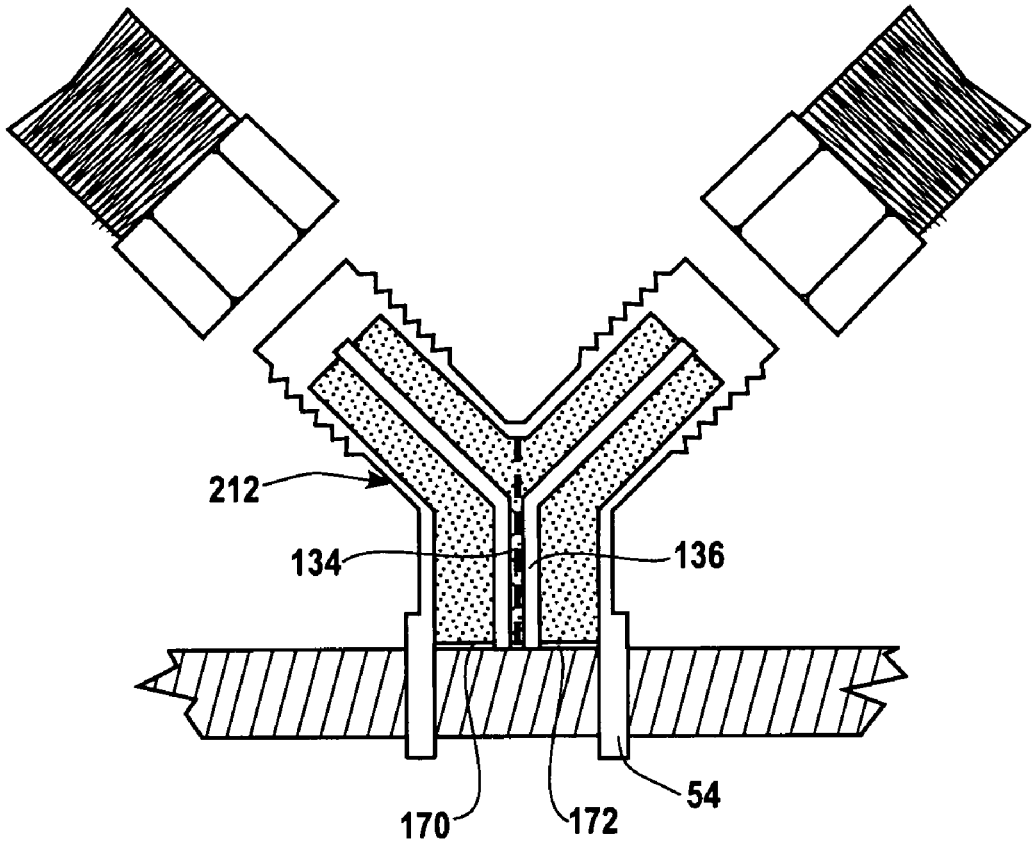
FIG. 5 is a simplified cross-sectional view of the electronics system shown in FIG. 1 employing a connector mounted to a printed circuit board in accordance with a second alternate embodiment of the present invention.

Alternatively, the ends of electrically conductive elements 34 and 36 may be sufficiently short so as not to extend beyond bulwark 54, shown in FIG. 5 by electrically conductive elements 134 and 136 of connector 212 so as not to extend through PCB 14 and/or touch bulwark 54. Specifically, connector 212 is substantially the same as connector 12, shown in FIG. 1, excepting that electrically conductive elements 134 and 136 of FIG. 5 are provided a length that facilitates coupling the same to bond pads 170 and 172 that are positioned on a the same side of PCB 114 as connector 212. Electrically conductive elements 134 and 136 are typically coupled to bond pads 170 and 172 using soldering techniques.

Although the foregoing invention has been described in some detail for purposes of clarity and understanding, it will be apparent that certain changes and modifications may be made that are within the scope of the invention. Accordingly, the present embodiments described above are to be considered as illustrative and not restrictive, and the invention is not to be limited to the details given herein, but may be defined by the appended claims, including full scope of equivalents thereof.

What is claimed is:

1. An electrical connector comprising:

a body having a first aperture, said body being a single structure that includes a bulwark and said bulwark extending through a printed circuit board and encompassing a throughway formed in said printed circuit board, said body extending from said first aperture and terminating in two spaced-apart termini, each of which includes an aperture, defining second and third apertures and a first volume extending between said first and second apertures and a second volume extending between said first and third apertures, wherein said body is composed of a conductive material;

a plurality of spaced-apart electrically conductive elements, a first subset of which extends through said first volume and a second subset of which extends through said second volume; and an insulating mass extending between said first, second and third apertures, with said plurality of spaced-apart electrically conductive elements extending through said electrically insulating mass, wherein said insulating mass terminates at an opening of said throughway.

2. The connector as recited in claim 1 wherein said first subset extends between said first aperture and said second aperture and said second subset extends between said first aperture and said third aperture.

3. The connector as recited in claim 1 wherein said first sub-set extends between said first aperture and said second aperture, and said second subset extends between said first aperture and said third aperture, said first aperture having a central axis, with said first subset being spaced-apart from said central axis.

4. The connector as recited in claim 1 wherein said first and second apertures each has a central axis, with said first subset being spaced-apart from said central axis of said first aperture and being collinear with said central axis of said second aperture.

5. The connector as recited in claim 1 wherein said first aperture has a central axis, with said first and second subsets being spaced-apart from said central axis.

6. The connector as recited in claim 1 wherein said first, second and third apertures each includes an axis of symmetry, with said first subset lying on the axis of symmetry of said second aperture and said second subset lying on the axis of symmetry of said third aperture, and said first and second subsets being spaced-apart from a central axis of said first aperture.

7. The connector as recited in claim 1 wherein said bulwark defining said first aperture and extending therefrom and terminating proximate to a junction, with second and third portions of said body extending from said junction, said second portion extending away from said third portion and terminating in said second aperture, and said third portion extending away from said second portion and terminating in said third aperture.

8. The connector as recited in claim 1 wherein said-bulwark defining said first aperture and extending therefrom and terminating proximate to a junction, with second and third portions of said body extending from said junction, said second portion extending away from said bulwark and terminating in said second aperture having a first central axis associated therewith, and said third portion extending away from said bulwark and terminating in said third aperture, having a second central axis associated therewith, forming a right angle with respect to said second central axis.

9. The connector as recited in claim 1 wherein said bulwark defining said first aperture and extending therefrom and terminating proximate to a junction, with second and third portions of said body extending from said junction, said second portion extending away from said junction and terminating in said second aperture, having a first central axis associated therewith, and said third portion extending away from said junction and terminating in said third aperture, having a second central axis associated therewith that extends parallel to said first central axis.

10. An electrical connector comprising:

a body having a first aperture, said being a single structure that body includes a bulwark and said bulwark extending through a printed circuit board and encompassing a throughway formed in said printed circuit board, said body extending from said first aperture and terminating in two spaced-apart termini, each of which includes an aperture, defining second and third apertures, wherein said body is composed of a conductive material;

a plurality of spaced-apart electrically conductive elements, a first subset of which extends through said first volume and a second subset of which extends through said second volume, said first sub-set extending between said first aperture and said second aperture, with said second subset extending between said first aperture and said third aperture and said first aperture having a central axis, with said first and second subsets being spaced-apart from said central axis, wherein said plurality of spaced-apart electrically conductive elements is connected to corresponding bondpads of an adjacent printed circuit board; and an insulating mass extending between said first, second and third apertures, with said plurality of spaced-apart electrically conductive elements extending through said electrically insulative material, wherein said insulating mass terminates at an opening of said throughway.

11. The connector as recited in claim 10 wherein said second aperture has an axis of symmetry, with said first subset being collinear with said axis of symmetry.

12. The connector as recited in claim 10 wherein said second and third apertures each has an axis of symmetry, with said first subset being collinear with the axis of symmetry of said second aperture and said second subset being collinear with the axis of symmetry of said third aperture.

13. An electrical connector comprising:

a body having a first aperture, said body being a single structure that includes a bulwark and said bulwark extending through a printed circuit board and encompassing a throughway formed in said printed circuit board, said body extending from said first aperture and terminating in two spaced-apart termini, each of which includes an aperture, defining second and third apertures; an electrically insulating mass extending between said first, second and third apertures, wherein said body is composed of a conductive material; and a plurality of spaced-apart electrically conductive elements extending through said electrically insulating mass, with a first subset extending between said first aperture and said second aperture and a second subset extending between said first aperture and said third aperture, wherein said plurality of spaced-apart electrically conductive elements is connected to corresponding bondpads of an adjacent printed circuit board, wherein said first aperture has a central axis, with said first subset being spaced-apart from said central axis, and wherein said insulating mass is absent in said throughway.

14. The connector as recited in claim 13 wherein said first and second apertures each has a central axis, with said first subset being spaced-apart from the central axis of said first aperture and being collinear with the central axis of said second aperture.

15. The connector as recited in claim 13 wherein said first aperture has a central axis, with said first and second subsets being spaced-apart from said central axis.

16. The connector as recited in claim 13 wherein said first, second and third apertures each includes an axis of symmetry, with said first subset lying on the axis of symmetry of said second aperture and said second subset lying on the axis of symmetry of said third aperture, and said first and second subsets being spaced-apart from a central axis of said first aperture.

* * * * *